US011145983B1

(12) United States Patent
Tarng et al.

(10) Patent No.: US 11,145,983 B1
(45) Date of Patent: Oct. 12, 2021

(54) SUBSTRATE-INTEGRATED-WAVEGUIDE-FED CAVITY-BACKED DUAL-POLARIZED PATCH ANTENNA

(71) Applicant: NATIONAL CHIAO TUNG UNIVERSITY, Hsinchu (TW)

(72) Inventors: Jenn-Hwan Tarng, Hsinchu (TW); Chih-Wei Chiu, Zhubei (TW); Nai-Chen Liu, Taichung (TW)

(73) Assignee: National Chiao Tung University, Hsinchu (TW)

( * ) Notice: Subject to any disclaimer, the term of this patent is extended or adjusted under 35 U.S.C. 154(b) by 0 days.

(21) Appl. No.: 17/036,107

(22) Filed: Sep. 29, 2020

(30) Foreign Application Priority Data

Jun. 23, 2020 (TW) ..... 109121297

(51) Int. Cl.
*H01Q 9/04* (2006.01)
*H01Q 13/18* (2006.01)
*H01Q 1/22* (2006.01)

(52) U.S. Cl.
CPC ..... *H01Q 9/0457* (2013.01); *H01Q 1/2283* (2013.01); *H01Q 9/0492* (2013.01); *H01Q 13/18* (2013.01)

(58) Field of Classification Search
CPC .. H01Q 1/2283; H01Q 9/0407; H01Q 9/0428; H01Q 9/0435; H01Q 9/0442; H01Q 9/045; H01Q 9/0457; H01Q 9/0478; H01Q 9/0492; H01Q 21/0006; H01Q 21/0031; H01Q 21/0037; H01Q 21/0043;
(Continued)

(56) References Cited

U.S. PATENT DOCUMENTS

2016/0365638 A1* 12/2016 Luk ..... H01Q 9/285
2017/0040703 A1 2/2017 Cheng et al.

FOREIGN PATENT DOCUMENTS

CN 101242027 A 8/2008
CN 203760675 U 8/2014
CN 104934702 A 9/2015
(Continued)

OTHER PUBLICATIONS

Z. Chen, H. Liu, J. Yu, and X. Chen, "High gain, broadband and dual-polarized substrate integrated waveguide cavity-backed slot antenna array for 60 GHz band," IEEE Access., vol. 6, pp. 31012-31022,2018.

(Continued)

*Primary Examiner* — Robert Karacsony
(74) *Attorney, Agent, or Firm* — Michael Best & Friedrich LLP

(57) ABSTRACT

A dual-polarized patch antenna includes a first insulating substrate; conductive connections, each of which passes through the first insulating substrate, and which are arranged to form a resonant cavity and two feeding ports; first and second metal layers respectively disposed on two opposite surfaces of the first insulating substrate, the second metal layer being formed with a cross-shaped slot that corresponds in position to the resonant cavity; a second insulating substrate disposed on the second metal layer; and four radiation patch units disposed on the second insulating substrate, and corresponding in position to four regions that are on the second metal layer and that are spaced apart by the cross-shaped slot.

9 Claims, 10 Drawing Sheets

(58) Field of Classification Search
CPC .. H01Q 21/005; H01Q 21/064; H01Q 21/065; H01Q 21/068; H01Q 21/24; H01Q 13/18
See application file for complete search history.

(56) References Cited

FOREIGN PATENT DOCUMENTS

| | | | |
|---|---|---|---|
| CN | 103943963 | B | 1/2016 |
| CN | 108550981 | A | 9/2018 |
| CN | 209232965 | U | 8/2019 |

OTHER PUBLICATIONS

J. Zhu, S. Li, S. Liao, Y. Yang, and H. Zhu, "60 GHz substrate-integrated-waveguide-fed patch antenna array with quadri-polarization," IEEE Transactions on Antennas and Propagation., vol. 66, No. 12, pp. 7406-7411, Dec. 2018.

S. Mukherjee and A. Biswas, "Substrate integrated waveguide (SIW) cavity backed slot antenna for polarization diversity application," in Proc. IEEE Appl. Electromagn. Conf., 2015, pp. 1-2.

Search Report appended to an Office Action, which was issued to Taiwanese counterpart Application No. 109121297 by the TIPO dated May 17, 2021 with an English translation thereof (2 pages).

* cited by examiner

SUBSTRATE-INTEGRATED-WAVEGUIDE-FED CAVITY-BACKED DUAL-POLARIZED PATCH ANTENNA

CROSS-REFERENCE TO RELATED APPLICATION

This application claims priority of Taiwanese Patent Application No. 109121297, filed on Jun. 23, 2020.

FIELD

The disclosure relates to a dual-polarized patch antenna, and more particularly to a substrate-integrated-waveguide-fed cavity-backed dual-polarized patch antenna.

BACKGROUND

Because of highly advanced development of dual-polarized antenna technology, it is possible to implement a dual-polarized antenna, which has a high gain and uses only one radiation surface, in the millimeter band or in bands with even higher frequencies. For example, Chinese Patent Application Publication No. 108550981A discloses a dual-polarized slot antenna that includes, from top to bottom, a metal radiator, a feeding structure for horizontal polarization and a feeding structure for vertical polarization. That is, feeding ports for different polarizations are respectively located on substrates of different layers to achieve dual-polarized operation. As such, the dual-polarized slot antenna requires at least two substrates to implement its feeding network, resulting in high material costs and integration difficulty. In addition, slots of the dual-polarized slot antenna are limited to a length of about ½ wavelength, so the dual-polarized slot antenna has difficulty radiating a radio frequency signal with a frequency deviated from its operating frequency, and has a narrow bandwidth.

SUMMARY

Therefore, an object of the disclosure is to provide a substrate-integrated-waveguide-fed cavity-backed dual-polarized patch antenna that can alleviate the drawbacks of the prior art.

According to the disclosure, the dual-polarized patch antenna includes a first insulating substrate, a plurality of conductive connections, a first metal layer, a second metal layer, a second insulating substrate and four radiation patch units. The first insulating substrate has a first surface, and a second surface that is opposite to the first surface of the first insulating substrate. Each of the conductive connections passes through the first insulating substrate from the first surface thereof to the second surface thereof. The conductive connections are spaced apart from one another, and are arranged to form a resonant cavity, a first feeding port that is connected to the resonant cavity, and a second feeding port that is connected to the resonant cavity and that is perpendicular to the first feeding port. The first metal layer is disposed on the first surface of the first insulating substrate. The second metal layer is disposed on the second surface of the first insulating substrate, and is formed with a cross-shaped slot that corresponds in position to the resonant cavity. The second insulating substrate is disposed on the second metal layer, and has a first surface that faces the second metal layer, and a second surface that is opposite to the first surface of the second insulating substrate. The radiation patch units are disposed at intervals and symmetrically on the second surface of the second insulating substrate, and correspond in position and respectively to four regions that are on the second metal layer and that are spaced apart by the cross-shaped slot.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
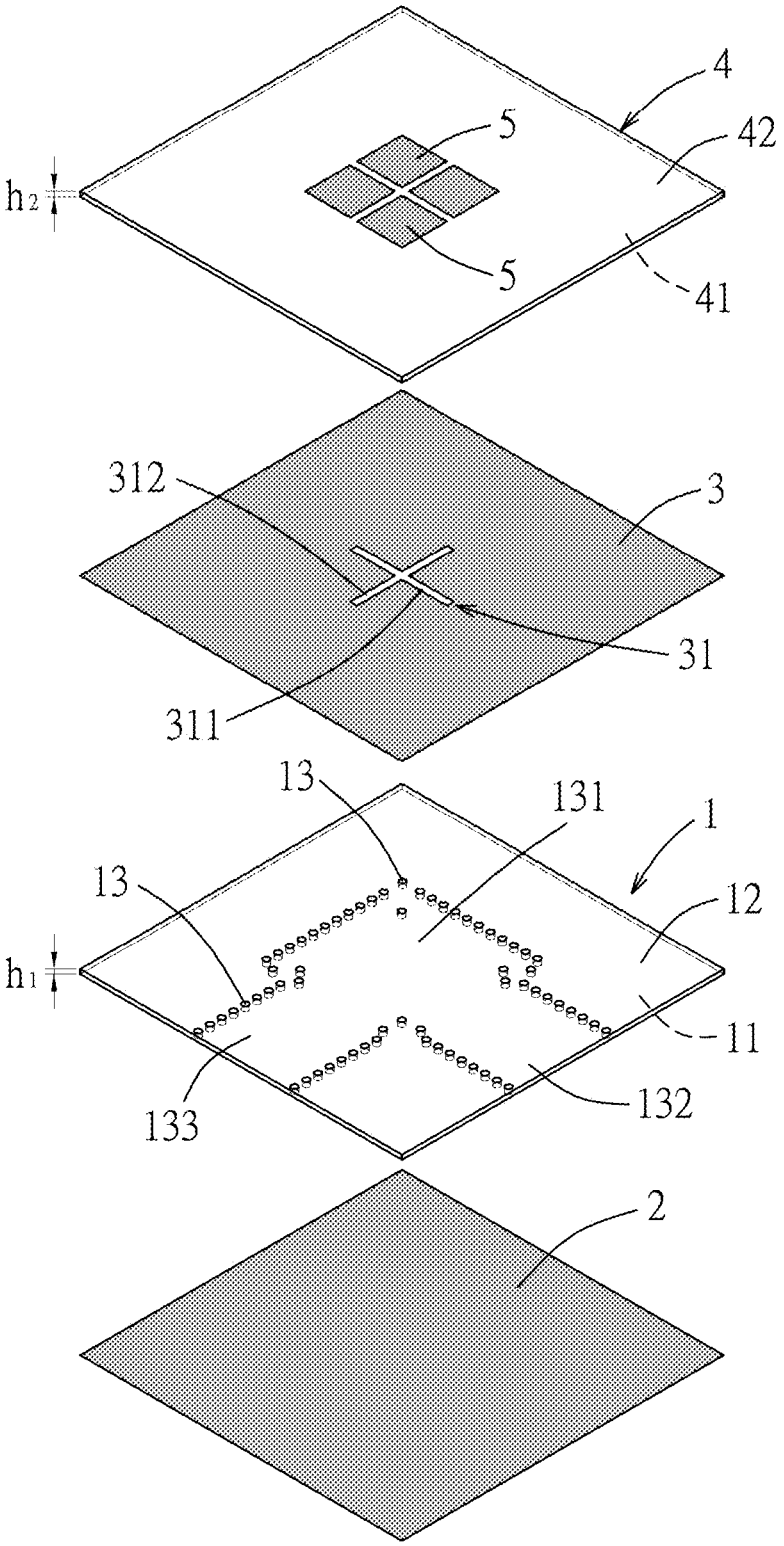
FIG. 1 is an exploded perspective view of an embodiment of a dual-polarized patch antenna according to the disclosure.

Referring to FIGS. 1 to 4, an embodiment of a dual-polarized patch antenna according to the disclosure includes a first insulating substrate 1, a plurality of conductive connections 13, a first metal layer 2, a second metal layer 3, a second insulating substrate 4 and four radiation patch units 5.

The first insulating substrate 1 has a first surface 11, and a second surface 12 that is opposite to the first surface 11 of the first insulating substrate 1.

Each of the conductive connections 13 passes through the first insulating substrate 1 from the first surface 11 thereof to the second surface 12 thereof. The conductive connections 13 are spaced apart from one another, and are arranged to form a resonant cavity 131, a first feeding port 132 that is connected to the resonant cavity 131, and a second feeding port 133 that is connected to the resonant cavity 131 and that is perpendicular to the first feeding port 132. Each of the conductive connections 13 may be a solid metal rivet (e.g., a copper post) that fills a respective through hole of the first insulating substrate 1, or may be a conductive channel that is formed by coating a wall which defines the respective through hole of the first insulating substrate 1 with conductive material.

Figure 2:
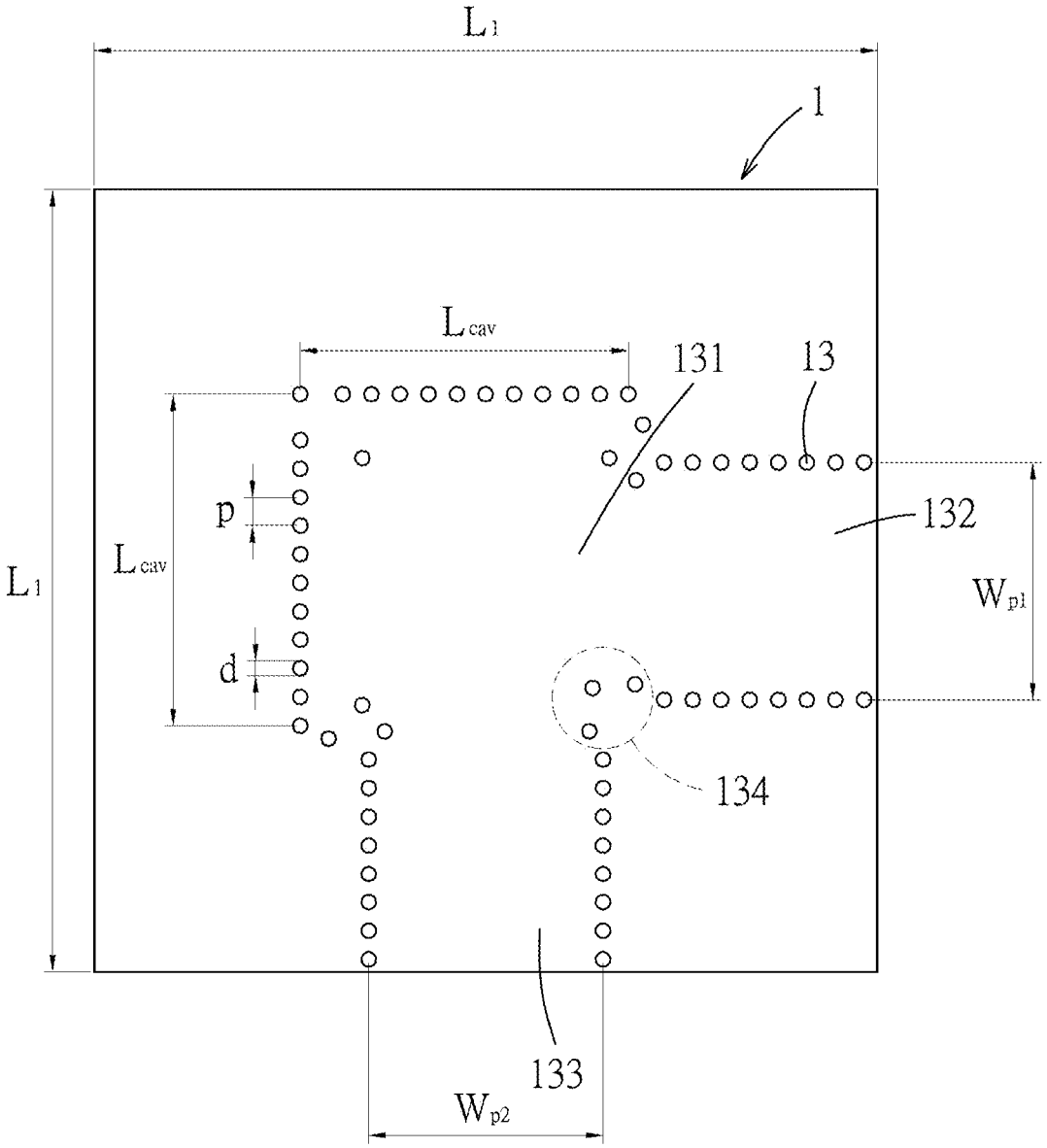
FIG. 2 is a top view of a first insulating substrate and a plurality of conductive connections of the embodiment.

As shown in FIG. 2, in this embodiment, the resonant cavity 131 is substantially square. An operating frequency of said dual-polarized patch antenna is determined by dimensions of the resonant cavity 131, and is equal to $$\frac{1}{2\cdot\sqrt{\mu\cdot\varepsilon}}\cdot\sqrt{\left(\frac{m}{L_{eff}}\right)^2+\left(\frac{n}{L_{eff}}\right)^2+\left(\frac{p}{h_1}\right)^2},$$

where $$L_{eff}=L_{cav}-1.08\cdot\frac{d^2}{p}+0.1\cdot\frac{d^2}{L_{cav}},$$

"$L_{eff}$" denotes an effective side length of the resonant cavity 131, "$L_{cav}$" denotes an actual side length of the resonant cavity 131, "d" denotes a diameter of each of the conductive connections 13, "p" denotes a center-to-center distance between two adjacent ones of the conductive connections 13, "$h_1$" denotes a thickness of the first insulating substrate 1, "ε" denotes a dielectric constant of the first insulating substrate 1, "μ" denotes a permeability of the first insulating substrate 1, "m" denotes a number of changes of a horizontal electric field, "n" denotes a number of changes of a vertical electric field, $$\frac{p}{d}<3,\ \frac{d}{w}<\frac{1}{5},$$

and "w" denotes a width of each of the first and second feeding ports 132, 133 (i.e., $w=W_{p1}=W_{p2}$).

As shown in FIG. 2, in this embodiment, the first and second feeding ports 132, 133 are adjacent to a corner of the resonant cavity 131, and multiple ones (e.g., three) of the conductive connections 13 at the corner are arranged to form a concave structure 134 that recesses toward a center of the resonant cavity 131. The concave structure 134 can enhance isolation between the first and second feeding ports 132, 133, so that a radio frequency signal fed to the first feeding port 132 will not enter the second feeding port 133 to interfere with a radio frequency signal fed to the second feeding port 133, and so that the radio frequency signal fed to the second feeding port 133 will not enter the first feeding port 132 to interfere with the radio frequency signal fed to the first feeding port 132, thereby reducing insertion loss.

The first metal layer 2 is disposed on the first surface 11 of the first insulating substrate 1, and is, for example, a copper foil.

Figure 3:
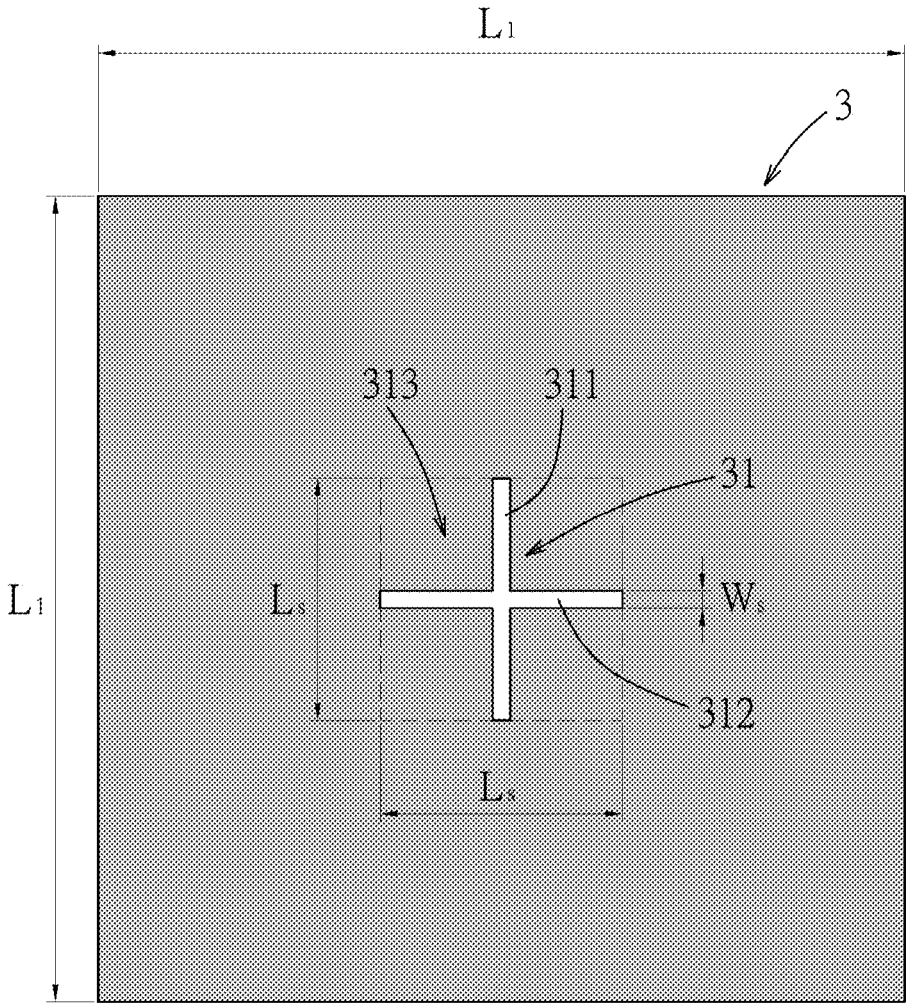
FIG. 3 is a top view of a metal layer of the embodiment.

The second metal layer 3 is disposed on the second surface 12 of the first insulating substrate 1, and is formed with a cross-shaped slot 31 that corresponds in position to the resonant cavity 131. As shown in FIGS. 1 and 3, in this embodiment, the cross-shaped slot 31 includes a first slot portion 311 that is parallel to the first feeding port 132, and a second slot portion 312 that is perpendicular to the first slot portion 311 and that is parallel to the second feeding port 133. The first and second slot portions 311, 312 have the same length, and the length thereof is greater than one-half of a wavelength that corresponds to the operating frequency of the dual-polarized patch antenna.

It should be noted that the first insulating substrate 1, the conductive connections 13 and the first and second metal layers 2, 3 can be implemented using a double-sided printed circuit board. The double-sided printed circuit board includes a substrate layer, which is, for example, a prepreg made of halogen free IT-88GMW and which corresponds to the first insulating substrate 1, and two copper layers, which are respectively on both sides of the substrate layer and which respectively correspond to the first and second metal layers 2, 3. First, the double-sided printed circuit board is drilled with a plurality of through holes that cooperatively define the shapes of the resonant cavity 131 and the first and second feeding ports 132, 133. Then, each of the through holes is lined with a solid metal rivet (e.g., a copper post) that serves as a respective one of the conductive connections 13, or a wall defining the through hole is coated with copper to form a conductive channel that serves as the respective one of the conductive connections 13. Finally, both sides of the double-sided printed circuit board are leveled with gel material (e.g., copper paste, resin, etc.). In this way, the resonant cavity 131 and the first and second feeding ports 132, 133 are formed, and there are no holes in the first and second metal layers 2, 3.

The second insulating substrate 4 is disposed on the second metal layer 3, and has a first surface 41 that faces the second metal layer 3, and a second surface 42 that is opposite to the first surface 41 of the second insulating substrate 4. The second insulating substrate 4 is, for example, a laminate made of halogen free IT-88GMW.

Figure 4:
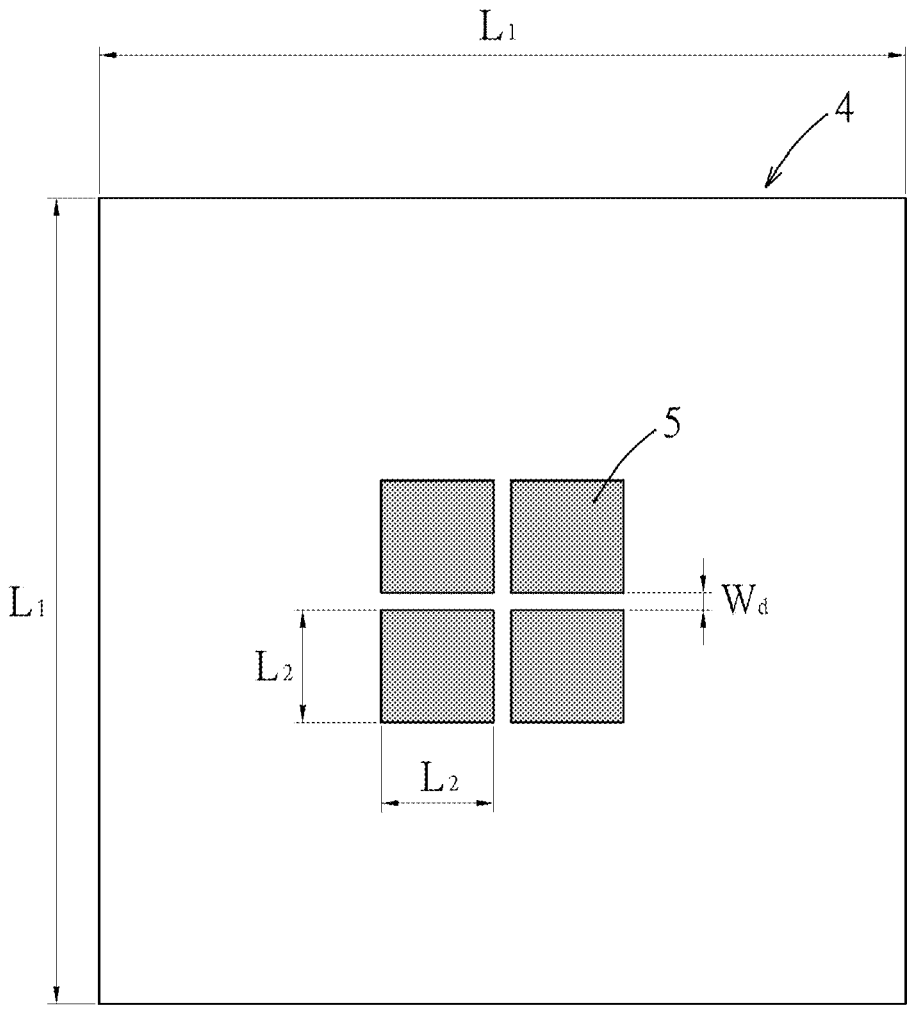
FIG. 4 is a top view of a second insulating substrate and four radiation patch units of the embodiment.

As shown in FIGS. 1, 3 and 4, the radiation patch units 5 are disposed at intervals and symmetrically on the second surface 42 of the second insulating substrate 4, and correspond in position and respectively to four regions 313 that are on the second metal layer 3 and that are spaced apart by the cross-shaped slot 31. In this embodiment, each of the radiation patch units 5 includes a square metal plate (e.g., a copper foil) that has a side length of $$L_2=0.32\cdot\frac{\lambda_0}{\sqrt{\varepsilon_r}},$$

where $\varepsilon_r$ denotes a dielectric constant of the second insulating substrate 4, and $\lambda_0$ denotes the wavelength that corresponds to the operating frequency of the dual-polarized patch antenna. Therefore, the shorter the side length ($L_2$), the shorter the wavelength ($\lambda_0$) (i.e., the higher the operating frequency). On the contrary, the longer the side length ($L_2$), the longer the wavelength ($\lambda_0$) (i.e., the lower the operating frequency). In other words, the dimensions of the radiation patch units 5 influence the operating frequency of the dual-polarized patch antenna. In addition, parasitic capacitances, each of which exists between two adjacent ones of the radiation patch units 5 and is related to a distance ($W_d$) between the two radiation patch units 5, influence a bandwidth of the dual-polarized patch antenna. Therefore, the bandwidth of the dual-polarized patch antenna can be increased by properly designing the distance ($W_d$)).

Figure 5:
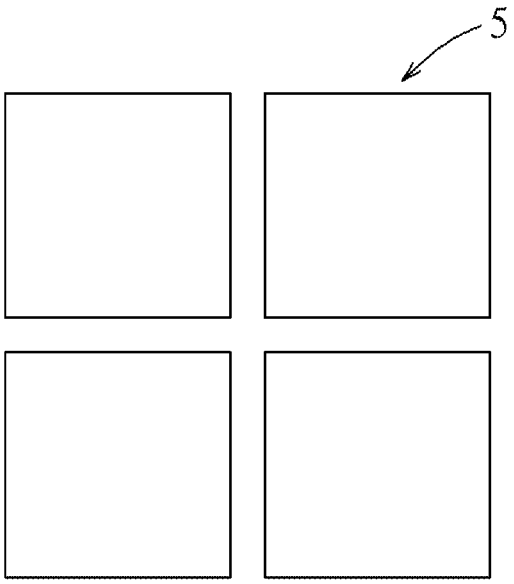
FIG. 5 is a top view of each of the radiation patch units of a modification of the embodiment.
Figure 6:
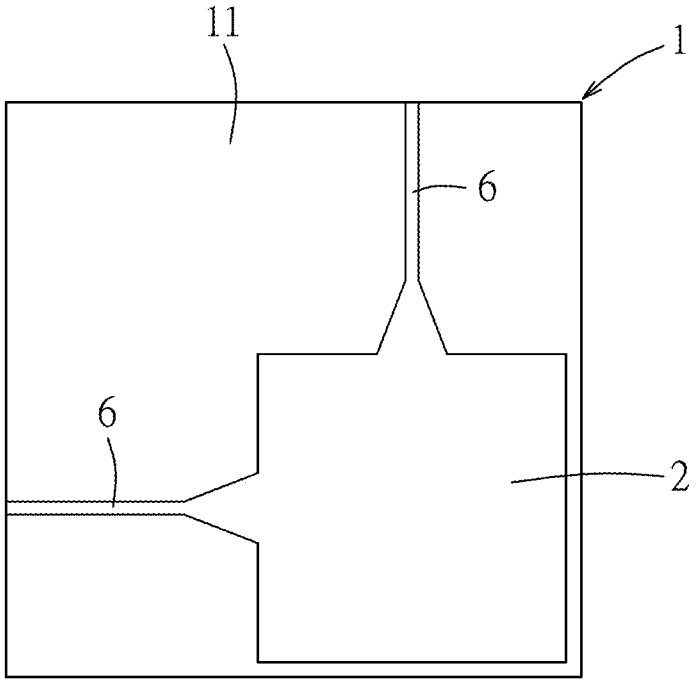
FIG. 6 is a bottom view of the first insulating substrate, the first metal layer and two microstrips of another modification of the embodiment.

It should be noted that, referring to FIG. 5, in other embodiments, each of the radiation patch units 5 may include a number ($N^2$) of miniaturized radiation patches (e.g., rectangular metal plates) to radiate or receive radio frequency signals, where N is an integer greater than one. For illustration purposes, N=2 in FIG. 5. Moreover, referring to FIG. 6, in other embodiments, the dual-polarized patch antenna may further include two microstrips 6. The microstrips 6 are disposed on the first surface 11 of the first insulating substrate 1, and are connected to the first metal layer 2. Radio frequency signals are fed to the first metal layer 2 via the microstrips 6.

Referring back to FIGS. 1-4, in this embodiment, during dual-polarized transmission operation, two radio frequency signals with different polarizations are received at the first metal layer 2, are fed to the resonant cavity 131 respectively via the first and second feeding ports 132, 133, are coupled to the radiation patch units 5 through the cross-shaped slot 31, and are radiated by the radiation patch units 5. During dual-polarized receive operation, two radio frequency signals with different polarizations are received at the radiation patch units 5, are coupled to the resonant cavity 131 via the cross-shaped slot 31, and are fed to the first metal layer 2 respectively via the first and second feeding ports 132, 133.

In this embodiment, the operating frequency of the dual-polarized patch antenna is 28 GHz (i.e., the dual-polarized patch antenna radiates or receives radio frequency signals each with a frequency approximating or equal to 28 GHz), and example values for various dimensions of the dual-polarized patch antenna are given in the table below.

| $h_1$ | $h_2$ | $L_{cav}$ | $W_{p1}$ | $W_{p2}$ | p |
|---|---|---|---|---|---|
| 0.254 | 0.254 | 6.93 | 5.03 | 5.03 | 0.6 |
| d | $L_1$ | $L_s$ | $W_s$ | $L_2$ | $W_d$ |
| 0.3 | 16.5 | 6.05 | 0.06 | 2.41 | 0.06 |

unit: mm

Figure 7:
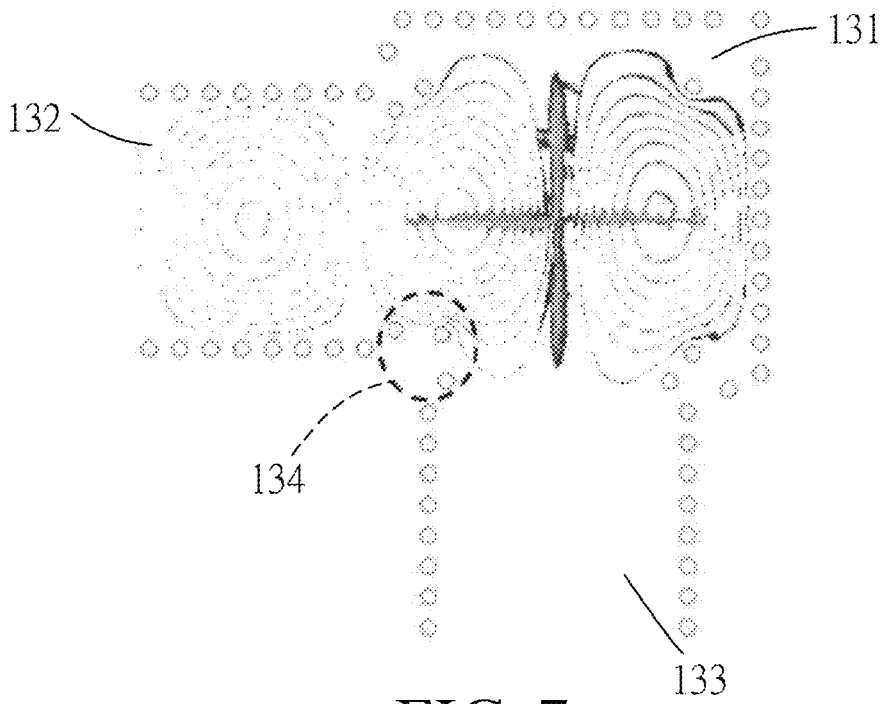
FIGS. 7 and 8 are plots illustrating transmission of a radio frequency signal in the embodiment in various scenarios where the radio frequency signal is fed to different ones of a first feeding port and a second feeding port of the embodiment.
Figure 8:
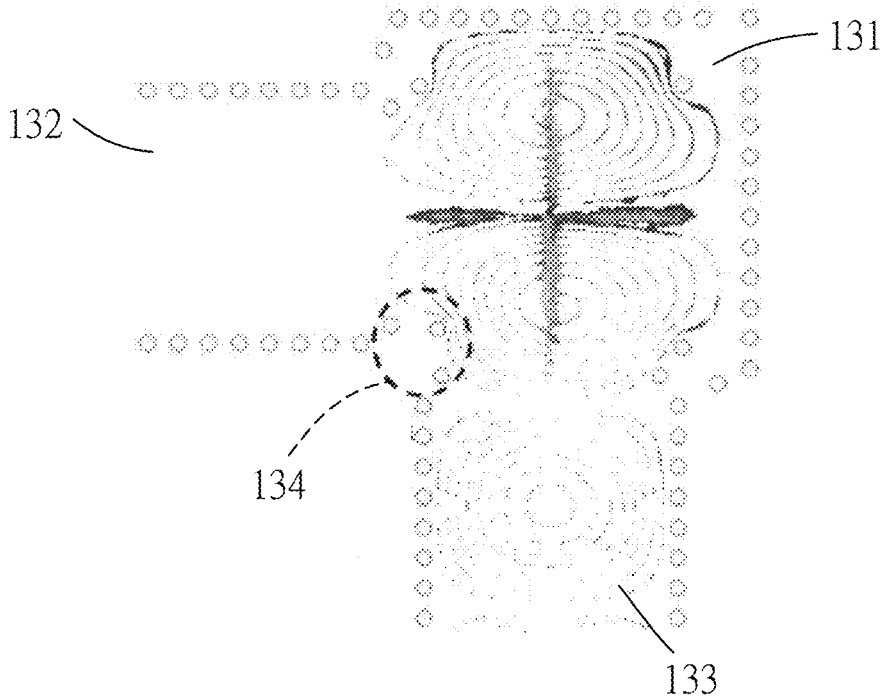
Figure 9:
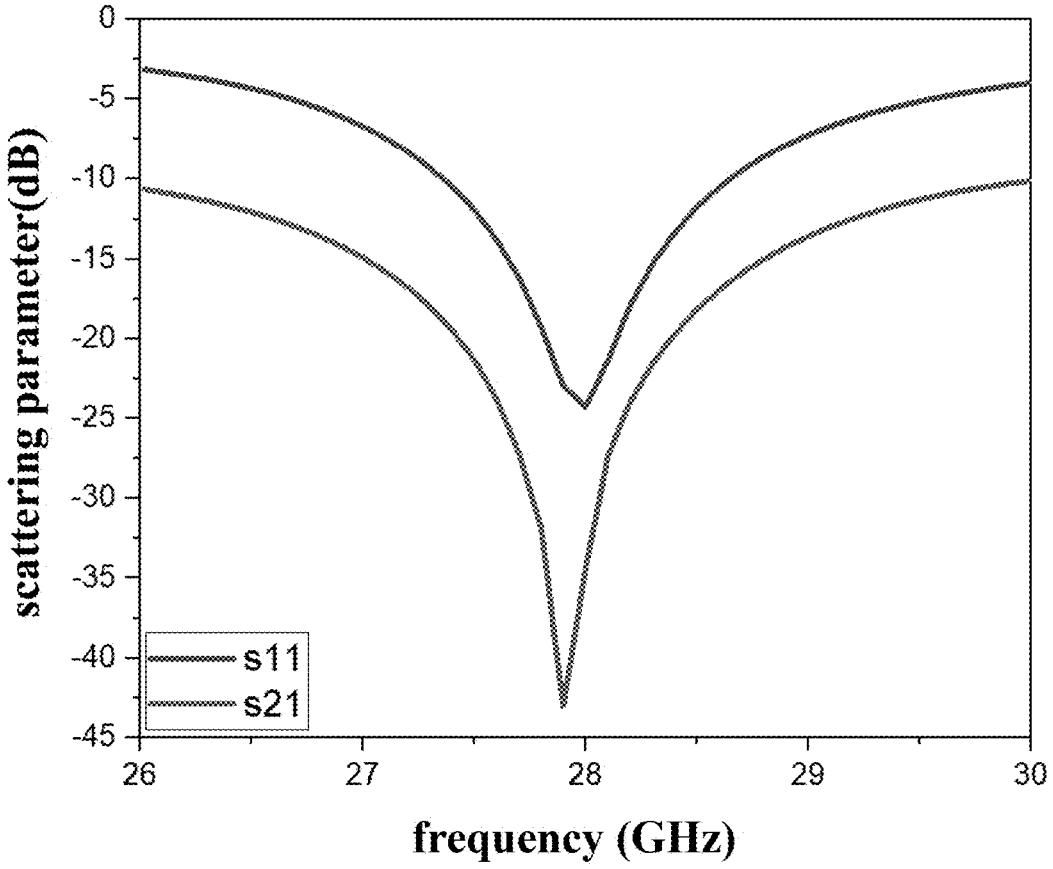
FIG. 9 is a plot illustrating various scattering parameters versus frequency characteristics of the embodiment.

FIGS. 7 and 8 are measurement results illustrating transmission of a radio frequency signal with a frequency of 28 GHz in the dual-polarized patch antenna of this embodiment in scenarios where the radio frequency signal is fed to different ones of the first and second feeding ports 132, 133. Referring to FIGS. 1 and 7, when the radio frequency signal is fed to the first feeding port 132 from the first metal layer 2, the radio frequency signal will enter the resonant cavity 131, but will not enter the second feeding port 133. Similarly, referring to FIGS. 1 and 8, when the radio frequency signal is fed to the second feeding port 133 from the first metal layer 2, the radio frequency signal will enter the resonant cavity 131, but will not enter the first feeding port 132. It can be reasonably determined from FIGS. 7 and 8 that the isolation between the first and second feeding ports 132, 133 is good. FIG. 9 illustrates measured scattering parameters (s11, s21) of the dual-polarized patch antenna of this embodiment in a scenario where the frequency of the radio frequency signal is within a range of 26 GHz to 30 GHz. It is known from FIG. 9 that the isolation between the first and second feeding ports 132, 133 (see FIG. 1), i.e., an absolute value of the scattering parameter (s21), is greater than 20 dB in a range of 27.5 GHz to 28.35 GHz.

Figure 10:
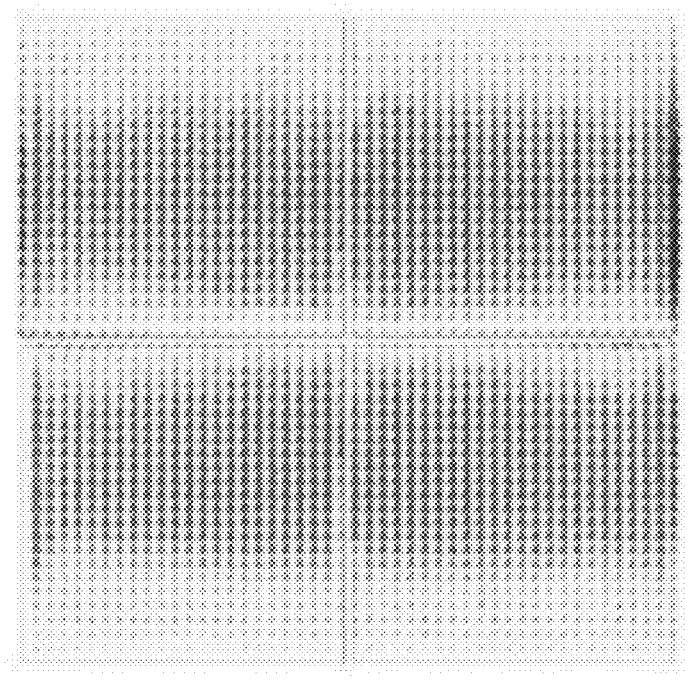
FIGS. 10 and 11 are plots illustrating surface current distribution of the radiation patch units in the scenarios where the radio frequency signal is fed to different ones of the first and second feeding ports.
Figure 11:
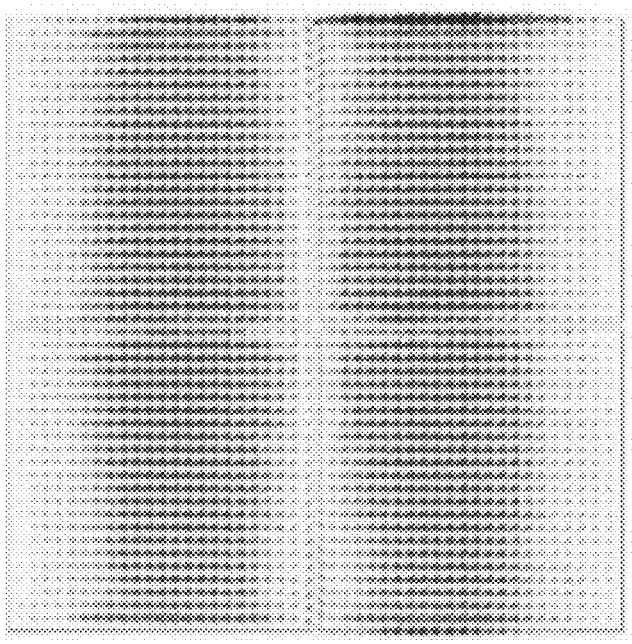

Referring to FIGS. 1, 10 and 11, when the radio frequency signal is coupled to the radiation patch units 5 from the resonant cavity 131 via the cross-shaped slot 31, current is uniformly distributed on surfaces of the radiation patch units 5 as shown in FIGS. 10 and 11 regardless of whether the radio frequency signal is fed to the resonant cavity 131 via the first feeding port 132 or the second feeding port 133. It can be reasonably determined from FIGS. 10 and 11 that the radio frequency signal is well coupled to the radiation patch units 5 via the cross-shaped slot 31.

Figure 12:
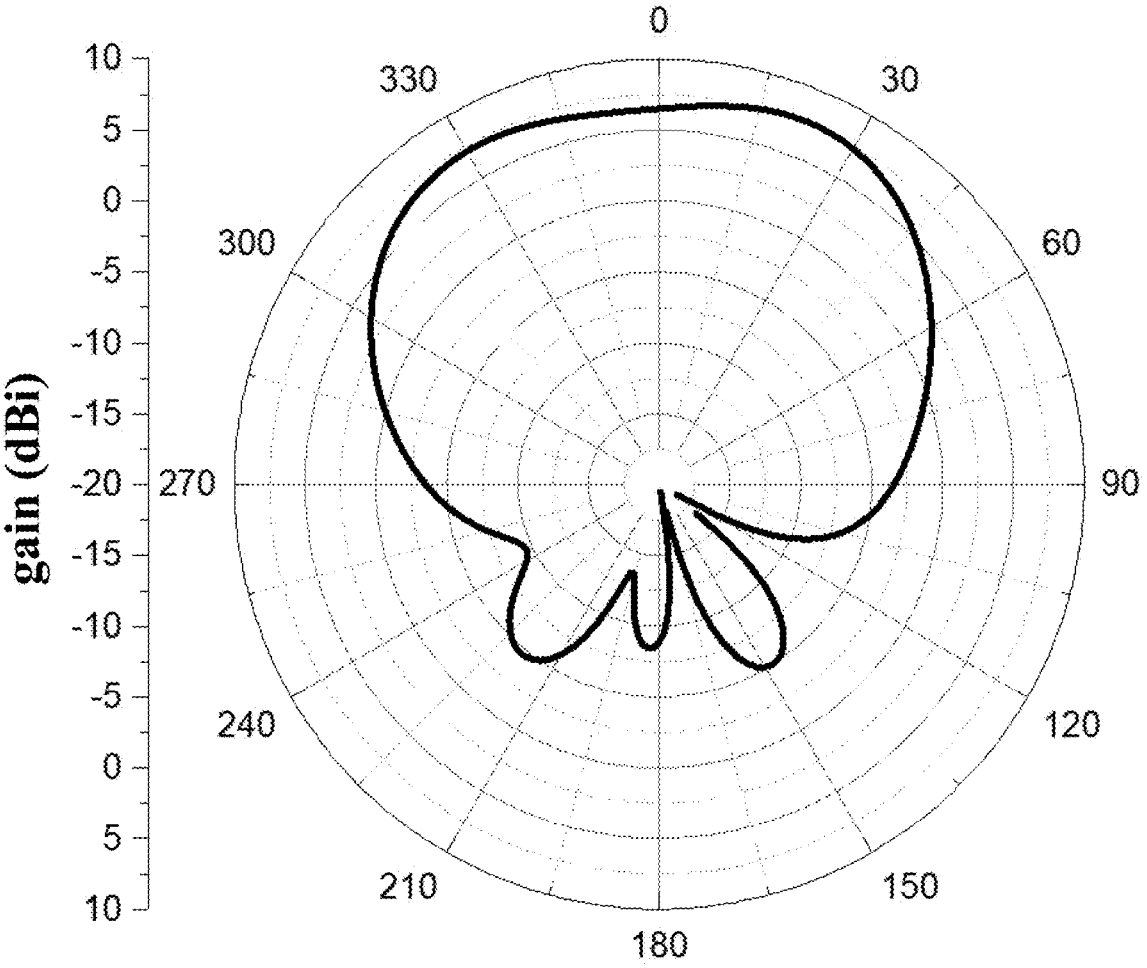
FIG. 12 is a plot illustrating an E-plane radiation pattern of the embodiment in the scenario where the radio frequency signal is fed to the first feeding port.
Figure 13:
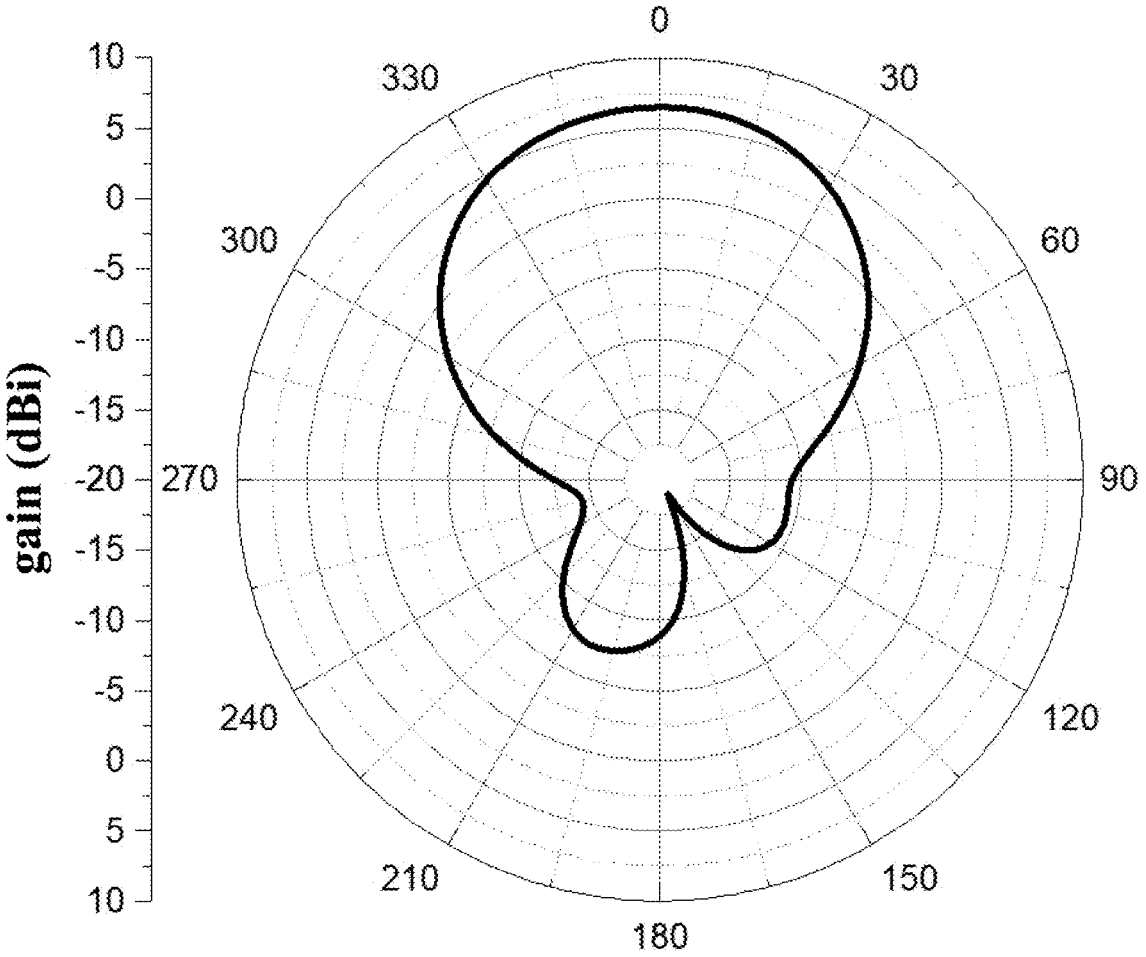
FIG. 13 is a plot illustrating an H-plane radiation pattern of the embodiment in the scenario where the radio frequency signal is fed to the first feeding port.

FIG. 12 illustrates an E-plane radiation pattern of the dual-polarized patch antenna of this embodiment in the scenario where the radio frequency signal is fed to the first feeding port 132 (see FIG. 1). FIG. 13 illustrates an H-plane radiation pattern of the dual-polarized patch antenna of this embodiment in the scenario where the radio frequency signal is fed to the first feeding port 132 (see FIG. 1). It can be reasonably determined from FIGS. 12 and 13 that the dual-polarized patch antenna of this embodiment has good directivity, and has a gain greater than 6 dBi. In addition, it is known from FIG. 9 that the dual-polarized patch antenna of this embodiment has a reflection coefficient at the first feeding port 132 (see FIG. 1), i.e., the scattering parameter (s11), far smaller than −10 dB in the range of 27.5 GHz to 28.35 GHz. It should be noted that, since the first and second feeding ports 132, 133 (see FIG. 1) are symmetrical in structure, radiation performances of the dual-polarized patch antenna of this embodiment in the scenario where the radio frequency signal is fed to the second feeding port 132 (see FIG. 1) are similar to those shown in FIGS. 9, 12 and 13.

Referring back to FIG. 1, in view of the above, the dual-polarized patch antenna of this embodiment has the following advantages.

1. Since two radio frequency signals with different polarizations can be fed to the resonant cavity 131 respectively via two substrate integrated waveguides (i.e., the first and second feeding ports 132, 133) that are formed using the same substrate (i.e., the first insulating substrate 1), and can be coupled to the radiation patch units 5 through the cross-shaped slot 31 that is formed on the second metal layer 3, dual-polarized operation can be achieved.

2. Since the two substrate integrated waveguides are formed using the same substrate, the dual-polarized patch antenna can have reduced material costs, and can be easily integrated with other feeding elements (e.g., the microstrips 6 shown in FIG. 6).

3. By properly designing the parasitic capacitances of the radiation patch units 5, the bandwidth of the dual-polarized patch antenna can be increased.

4. By virtue of the concave structure 134 that is formed between the first and second feeding ports 132, 133, the isolation between the first and second feeding ports 132, 133 can be enhanced, and the insertion loss can be reduced.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A dual-polarized patch antenna comprising:

a first insulating substrate having a first surface, and a second surface that is opposite to said first surface of said first insulating substrate;

a plurality of conductive connections each passing through said first insulating substrate from said first surface thereof to said second surface thereof, said conductive connections being spaced apart from one another, and being arranged to form a resonant cavity, a first feeding port that is connected to said resonant cavity, and a second feeding port that is connected to said resonant cavity and that is perpendicular to said first feeding port;

a first metal layer disposed on said first surface of said first insulating substrate;

a second metal layer disposed on said second surface of said first insulating substrate, and formed with a cross-shaped slot that corresponds in position to said resonant cavity;

a second insulating substrate disposed on said second metal layer, and having a first surface that faces said second metal layer, and a second surface that is opposite to said first surface of said second insulating substrate; and four radiation patch units disposed at intervals and symmetrically on said second surface of said second insulating substrate, and corresponding in position and respectively to four regions that are on said second metal layer and that are spaced apart by the cross-shaped slot.

2. The dual-polarized patch antenna of claim 1, wherein a radio frequency signal is received at said first metal layer, is fed to said resonant cavity via one of said first and second feeding ports, is coupled to said radiation patch units through the cross-shaped slot, and is radiated by said radiation patch units.

3. The dual-polarized patch antenna of claim 1, wherein the cross-shaped slot includes a first slot portion that is parallel to said first feeding port, and a second slot portion that is perpendicular to the first slot portion and that is parallel to said second feeding port.

4. The dual-polarized patch antenna of claim 3, wherein the first and second slot portions have the same length, and the length thereof is greater than one-half of a wavelength that corresponds to an operating frequency of said dual-polarized patch antenna.

5. The dual-polarized patch antenna of claim 1, wherein said resonant cavity is substantially square, and an operating frequency of said dual-polarized patch antenna is equal to $$\frac{1}{2\cdot\sqrt{\mu\cdot\varepsilon}}\cdot\sqrt{\left(\frac{m}{L_{eff}}\right)^2+\left(\frac{n}{L_{eff}}\right)^2+\left(\frac{p}{h_1}\right)^2},$$

where $$L_{eff}=L_{cav}-1.08\cdot\frac{d^2}{p}+0.1\cdot\frac{d^2}{L_{cav}},$$

$L_{eff}$ denotes an effective side length of said resonant cavity, $L_{cav}$ denotes an actual side length of said resonant cavity, d denotes a diameter of each of said conductive connections, p denotes a center-to-center distance between two adjacent ones of said conductive connections, $h_1$ denotes a thickness of said first insulating substrate, ε denotes a dielectric constant of said first insulating substrate, μ denotes a permeability of said first insulating substrate, m denotes a number of changes of a horizontal electric field, n denotes a number of changes of a vertical electric field, $$\frac{p}{d}<3,\ \frac{d}{w}<\frac{1}{5},$$

and w denotes a width of each of said first and second feeding ports.

6. The dual-polarized patch antenna of claim 1, wherein each of said radiation patch units includes a square metal plate that has a side length of $$0.32\cdot\frac{\lambda_0}{\sqrt{\varepsilon_r}},$$

where $\varepsilon_r$ denotes a dielectric constant of said second insulating substrate, and $\lambda_0$ denotes a wavelength that corresponds to an operating frequency of said dual-polarized patch antenna.

7. The dual-polarized patch antenna of claim 1, wherein each of said radiation patch units includes a number ($N^2$) of rectangular metal plates, where N is an integer greater than one.

8. The dual-polarized patch antenna of claim 1, wherein said first and second feeding ports are adjacent to a corner of said resonant cavity, and multiple ones of said conductive connections at said corner are arranged to form a concave structure that recesses toward a center of said resonant cavity.

9. The dual-polarized patch antenna of claim 1, further comprising a microstrip that is disposed on said first surface of said first insulating substrate, that is connected to said first metal layer, and that is to receive a radio frequency signal.

* * * * *